US009644443B1

(12) United States Patent
Johansen et al.

(10) Patent No.: US 9,644,443 B1
(45) Date of Patent: May 9, 2017

(54) REMOTELY-OPERATED WELLHEAD PRESSURE CONTROL APPARATUS

(71) Applicant: FHE USA LLC, Fruita, CO (US)

(72) Inventors: Keith C. Johansen, Fruita, CO (US); Nicolas G. Snoke, Grand Junction, CO (US)

(73) Assignee: FHE USA LLC, Fruita, CO (US)

( * ) Notice: Subject to any disclaimer, the term of this patent is extended or adjusted under 35 U.S.C. 154(b) by 0 days.

(21) Appl. No.: 15/341,864

(22) Filed: Nov. 2, 2016

Related U.S. Application Data

(60) Provisional application No. 62/263,889, filed on Dec. 7, 2015.

(51) Int. Cl.
*E21B 33/038* (2006.01)
*E21B 33/03* (2006.01)
*E21B 34/02* (2006.01)

(52) U.S. Cl.
CPC ..... *E21B 33/038* (2013.01); *E21B 33/03* (2013.01); *E21B 34/02* (2013.01)

(58) Field of Classification Search
CPC ..... E21B 33/038; E21B 43/013; E21B 17/02; E21B 23/00; E21B 33/03; F16L 37/002; F16L 37/62
See application file for complete search history.

(56) References Cited

U.S. PATENT DOCUMENTS 4,153,278 A * 5/1979 Ahlstone ..... F16L 27/06 285/146.3
4,441,742 A * 4/1984 Owens, III ..... E21B 33/038 166/340
4,526,406 A * 7/1985 Nelson ..... E21B 33/038 285/18
4,651,830 A * 3/1987 Crotwell ..... E21B 33/043 166/217
5,282,655 A * 2/1994 Marietta ..... E21B 33/03 285/315
6,125,939 A * 10/2000 Abreo, Jr. ..... E21B 33/043 166/208
6,129,149 A * 10/2000 Beall ..... E21B 33/038 166/344
8,474,537 B2 * 7/2013 Voss ..... E21B 33/038 166/338

(Continued)

*Primary Examiner* — Daniel P Stephenson
(74) *Attorney, Agent, or Firm* — Zeman-Mullen & Ford, LLP

(57) ABSTRACT

A wellhead pressure control fitting comprising a generally tubular Pressure Control Equipment (PCE) adapter configured to mate with pressure control equipment at a first adapter end, and with a receptacle inside a generally tubular pressure control assembly at a second adapter end. The pressure control assembly is configured to mate with a wellhead. Cooperating abutment surfaces form a high pressure seal when the second adapter end is compressively received into the receptacle. A plurality of cam locks on the exterior of the pressure control assembly rotate responsive to extension and retraction of the cam lock pistons. Cam lock rotation causes perimeter curvatures on the cam locks to bear down on corresponding curvatures on the second adapter end, which in turn compresses the second adapter end into the receptacle to form the seal. A locking ring may restrain the cam locks from rotation while the seal is enabled.

20 Claims, 15 Drawing Sheets

(56) References Cited

U.S. PATENT DOCUMENTS

| | | | | |
|---|---|---|---|---|
| 8,511,387 | B2 * | 8/2013 | Fraser | E21B 33/038 166/338 |
| 2003/0168857 | A1 * | 9/2003 | Jennings | F16L 37/002 285/322 |
| 2010/0139925 | A1 * | 6/2010 | McKay | E21B 17/085 166/343 |
| 2011/0025044 | A1 * | 2/2011 | McKay | E21B 33/038 285/80 |
| 2012/0222865 | A1 * | 9/2012 | Larson | E21B 33/038 166/340 |
| 2013/0093179 | A1 * | 4/2013 | Jenkins | E21B 17/017 285/1 |
| 2013/0341539 | A1 * | 12/2013 | Hughes | E21B 29/08 251/1.3 |
| 2014/0144648 | A1 * | 5/2014 | McKay | E21B 33/035 166/367 |
| 2014/0352944 | A1 * | 12/2014 | Devarajan | E21B 23/02 166/123 |
| 2015/0083430 | A1 * | 3/2015 | Jahnke | E21B 33/038 166/338 |
| 2016/0138352 | A1 * | 5/2016 | Leba | E21B 21/08 166/377 |
| 2016/0376863 | A1 * | 12/2016 | Older | E21B 43/013 166/368 |

* cited by examiner

REMOTELY-OPERATED WELLHEAD PRESSURE CONTROL APPARATUS

RELATED APPLICATIONS

This application claims the benefit of, and priority to, commonly-invented and commonly-assigned U.S. provisional patent application Ser. No. 62/263,889 filed Dec. 7, 2015. The entire disclosure of 62/263,889 is incorporated herein by reference.

FIELD OF THE DISCLOSURE

This disclosure is directed generally to pressure control equipment at the wellhead, and more specifically to a remotely-operated wellhead pressure control apparatus. Broadly, and without limiting the scope of this disclosure, the disclosed pressure control apparatus is a cam-locking wellhead attachment that can secure a connection to a pressurized wellhead connection remotely, without manual interaction at the wellhead.

BACKGROUND OF THE DISCLOSED TECHNOLOGY

Conventionally, wellhead connections to pressure control equipment are typically made by either a hand union or hammer union. Wellhead operators engaging or disengaging these conventional types of wellhead connections place themselves in danger of injury. The pressure control equipment to be connected to the wellhead is typically heavy, and remains suspended above the wellhead operator via use of a crane. Interacting with the crane operator, a technician at the wellhead below must struggle with the suspended load as it is lowered in order to achieve the proper entry angle into the wellhead to make a secure connection. The wellhead operator must then connect the wellhead to the pressure control equipment to the wellhead, typically via a bolted flanged connection. The bolts must be tightened manually by a person at the wellhead, typically via a "knock wrench" struck with a sledgehammer in order to get the bolts sufficiently tight to withstand the internal operating pressure. During this whole process, as noted, the operator is in physical danger of injuries, such as collision with the suspended pressure control equipment load, or pinched or crushed fingers and hands when securing the connection.

Wellhead operators are exposed to similar risks of injury during conventional removal of the pressure control equipment from the wellhead. The removal process is substantially the reverse of the engagement process described in the previous paragraph.

There is therefore a need in the well services industry to have a way to safely connect and disconnect pressure control equipment from the wellhead while minimizing the physical danger to human resources in the vicinity. The disclosed remotely-operated wellhead pressure control apparatus, is a hydraulically-actuated and -deactuated system that locks pressure control equipment to the wellhead via a remote control station.

SUMMARY AND TECHNICAL ADVANTAGES

These and other drawbacks in the prior art are addressed by the disclosed pressure control apparatus. Disclosed embodiments describe a cam lock design with a secondary lock, in which the disclosed pressure control apparatus replaces connections done conventionally either by hammering, torqueing, or with a quick union nut, all of which require the interaction of an operator to perform these operations. In such embodiments, a crane operator may place pressure control equipment (PCE) directly onto the wellhead via the disclosed pressure control apparatus's highly visible entry guide ("tulip"). The crane operator may then proceed to actuate the pressure control apparatus and secure the pressure control equipment in embodiments where the crane is equipped with the apparatus's remote controls. In alternative embodiments, a second operator may operate the pressure control apparatus remotely while the crane holds the pressure control equipment in the tulip. In currently preferred embodiments, the disclosed pressure control apparatus allows the pressure control equipment to be secured in the wellhead from up to 100 feet away from the wellhead, although the scope of this disclosure is not limited in this regard.

As noted, disclosed embodiments of the disclosed pressure control apparatus provide a secondary mechanical lock feature that holds the locked pressure connection secure without total loss in hydraulic pressure. Preferably, the apparatus may be adapted to fit any conventional well head, and may be available in several sizes, such as (without limitation) for 3-inch to 7-inch pipe. Although not limited to any particular pressure rating, the disclosed pressure control apparatus is preferably rated up to about 15,000 psi MAWP (maximum allowable working pressure). Although the embodiments described in this disclosure are described for applications in the oilfield industry, the disclosed pressure control apparatus is not limited to such applications. It will be appreciated that the apparatus also has applications wherever highly pressurized joint connections can be made more safely by remote actuation and deactuation.

Embodiments of the disclosed pressure control apparatus preferably also provide a "nightcap" option to cap the well if there will be multiple operations. Consistent with conventional practice in the field, the apparatus includes a nightcap option, available separately, for sealing off the wellhead while the PCE has been temporarily removed, such as at the end of the day. Embodiments including the nightcap enable the apparatus to remain connected to the wellhead, and wellhead pressure to be retained, in periods when PCE is temporarily removed. In such embodiments, the disclosed pressure control apparatus does not have to be removed and re-installed on the well head every time PCE is removed. Such embodiments obviate the need to suspend wellhead operations unnecessarily just to remove and re-install the apparatus every time PCE is removed.

It is therefore a technical advantage of the disclosed pressure control apparatus to reduce substantially the possibility of personal injury to wellhead operators during engagement and disengagement of pressure control equipment from wellheads. In addition to the paramount importance of providing a safe workplace, there are further ancillary advantages provided by the disclosed pressure control apparatus, such as improved personnel morale and economic advantages through reduction of lost time accidents and increased efficiency gains of more rapid rig ups.

Another technical advantage of the disclosed pressure control apparatus is that it provides a hands-free, secure, predictable connection between pressure control equipment and the wellhead. The disclosed primary cam-lock, in combination with the secondary lock feature, provides a predictable serviceably-tight connection every time. This is distinction to possible variances in the tightness provided by conventional hand- and knock wrench-tightening of the connection, whose degree of tightness may vary according to the technique and physical strength of the manual operator.

A further technical advantage of the disclosed pressure control apparatus is that, in embodiments in which a quick test port is provided, a conventional hand pump can conveniently deliver high pressure fluid to a portion of the pressure connection sealed between two sets of o-rings. It will be appreciated that the o-rings will limit or impede high pressure fluid flow into or out of the portion of the pressure connection between the two sets of o-rings. Embodiments of this disclosure provide a quick test port though the pressure control assembly into the flow-limited portion of the pressure connection. A hand pump may then be used to deliver fluid through the quick test port to the flow-limited portion. This allows the pressure integrity of the seals provided by the o-rings to be tested prior to applying high fluid pressures from the wellhead onto the pressure control apparatus's pressure connection. In other applications, the quick test port may be used to equalize pressure in the flow-limited portion of the pressure connection during service engagement and disengagement of the pressure control apparatus from the wellhead.

According to a first aspect, therefore, this disclosure describes embodiments of a wellhead pressure control fitting comprising a generally tubular Pressure Control Equipment (PCE) adapter having first and second adapter ends, the first adapter end configured to mate with pressure control equipment, the second adapter end providing a shaped end including an adapter end curvature; a generally tubular pressure control assembly having first and second assembly ends, the first assembly end providing a first assembly end interior and a first assembly end exterior, the second assembly end configured to mate with a wellhead; the first assembly end exterior having an exterior periphery, the exterior periphery providing a plurality of cam locks, each cam lock disposed to rotate about a corresponding cam lock pin, each cam lock pin anchored to the first assembly end exterior, each cam lock further providing a cam perimeter curvature; the first assembly end exterior further providing a plurality of cam lock pistons, one cam lock piston for each cam lock, wherein extension and retraction of the cam lock pistons causes rotation of the cam locks in opposing directions about their corresponding cam lock pins; the first assembly end exterior further providing a plurality of locking ring pistons, a locking ring connected to the locking ring pistons at a distal end thereof, the locking ring encircling the first assembly end proximate the cam locks, wherein extension of the locking ring pistons causes the locking ring to move to a position free of contact with the cam locks as the cam locks rotate about the cam lock pins, and wherein retraction of the locking ring pistons causes the locking ring to move so as to restrain the cam locks from rotation about the cam lock pins; the first assembly end interior providing a receptacle for receiving the second adapter end, the second adapter end and the receptacle further each providing cooperating abutment surfaces, the cooperating abutment surfaces forming a high pressure seal between the second adapter end and the receptacle when the second adapter end is compressively received into the receptacle; wherein, as the second adapter end enters the receptacle and engages the cooperating abutment surfaces, extension of the cam lock pistons causes the cam locks to rotate about the cam lock pins, which in turn causes the cam perimeter curvatures on the cam locks to cooperatively bear down on the adapter end curvature, which in turn compresses the second adapter end into the receptacle to form the high pressure seal; and wherein, once the high pressure seal is formed, retraction of the locking ring pistons causes the locking ring to move so as to restrain the cam locks from rotation about the cam lock pins.

In a second aspect, embodiments of the wellhead pressure control fitting include that each cam lock further provides a cam perimeter notch, each cam perimeter notch configured to engage the second adapter end as the second adapter end approaches entry into the receptacle.

In a third aspect, embodiments of the wellhead pressure control fitting include that the second assembly end further provides a vent line.

In a fourth aspect, embodiments of the wellhead pressure control fitting include that the second adapter end provides at least one o-ring seal configured to mate with the receptacle when the second adapter end is received into the receptacle.

In a fifth aspect, embodiments of the wellhead pressure control fitting include that the second adapter end provides at least first and second o-ring seals, and in which the first assembly end further provides a quick test port, the quick test port comprising a fluid passageway from the first assembly end exterior through to the first assembly end interior, wherein the quick test port is open to the first assembly end interior at a location selected to lie between the first and second o-ring seals when the second end adapter and the receptacle form the high pressure seal.

In a sixth aspect, embodiments of the wellhead pressure control fitting include that the locking ring is in an interference fit with the cam locks when retraction of the locking ring pistons causes the locking ring to move so as to restrain the cam locks from rotation about the cam lock pins.

In a seventh aspect, embodiments of the wellhead pressure control fitting include that each cam lock piston is connected to its corresponding cam lock via a pinned cam linkage, each pinned cam linkage including a link arm interposed between the cam lock piston and cam lock, each link arm connected to the cam lock via a first linkage pin, each link arm connected to the cam lock piston by a second linkage pin.

In an eighth aspect, embodiments of the wellhead pressure control fitting include that the cooperating abutment surfaces include a machined shoulder surface and a machined slope surface provided on the second adapter end, the receptacle further providing machined surfaces to mate with the shoulder surface and slope surface in forming the high pressure seal.

In an ninth aspect, embodiments of the wellhead pressure control fitting include that the PCE adapter is interchangeable with a generally tubular night cap adapter, the night cap adapter having first and second night cap ends, wherein the first night cap end is closed and sealed off against internal pressure, and wherein the second night cap end is dimensionally identical to the second adapter end on the PCE adapter.

The foregoing has outlined rather broadly some of the features and technical advantages of the disclosed pressure control apparatus technology, in order that the detailed description that follows may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described and as set forth in the appended claims.

BRIEF DESCRIPTION OF THE DRAWINGS

For a more complete understanding of embodiments described in detail below, and the advantages thereof, reference is now made to the following drawings, in which:

FIGS. 2 through 15 are illustrations depicting details and aspects of a currently preferred embodiment of pressure control assembly 200 operating according to FIG. 1, in which FIGS. 2 through 11 are freeze-frame illustrations in sequence, and in which further:

FIGS. 2 and 3 are perspective freeze-frame illustrations depicting adapter 250 approaching entry into pressure control assembly 200;

FIGS. 4 and 5 are elevation freeze-frames illustrations (unsectioned and partial cutaway views, respectively) depicting an upper portion of pressure control assembly 200, prior to entry of adapter 250;

FIGS. 6 and 7 are freeze-frame partial cutaway views depicting the entry of adapter 250 into the upper portion of pressure control assembly 200;

FIGS. 8 through 10 are magnified freeze-frame partial cutaway views of pressure control assembly 200 as adapter 250 engages its seat in receptacle 260;

FIG. 11 is a freeze-frame illustration depicting disengagement of adapter 250 from its seat in receptacle 260;

FIGS. 12 and 13 are perspective freeze-frame illustrations depicting night cap 270 entering and engaging upon pressure control assembly 200; and FIGS. 13 to 15 depict quick test ports 500 and associated manifold box 510 provided on pressure control assembly 200, wherein FIG. 14 is a section as shown on FIG. 12, and FIG. 15 is a magnified cutaway view of manifold box 510.

DETAILED DESCRIPTION

Reference is now made to FIGS. 1 through 15 in describing the currently preferred embodiments of the disclosed pressure control apparatus. For the purposes of the following disclosure, FIGS. 1 through 15 should be viewed together. Any part, item, or feature that is identified by part number on one of FIGS. 1 through 15 will have the same part number when illustrated on another of FIGS. 1 through 15. It will be understood that the embodiments as illustrated and described with respect to FIGS. 1 through 15 are exemplary, and the scope of the inventive material set forth in this disclosure is not limited to such illustrated and described embodiments.

Figure 1:
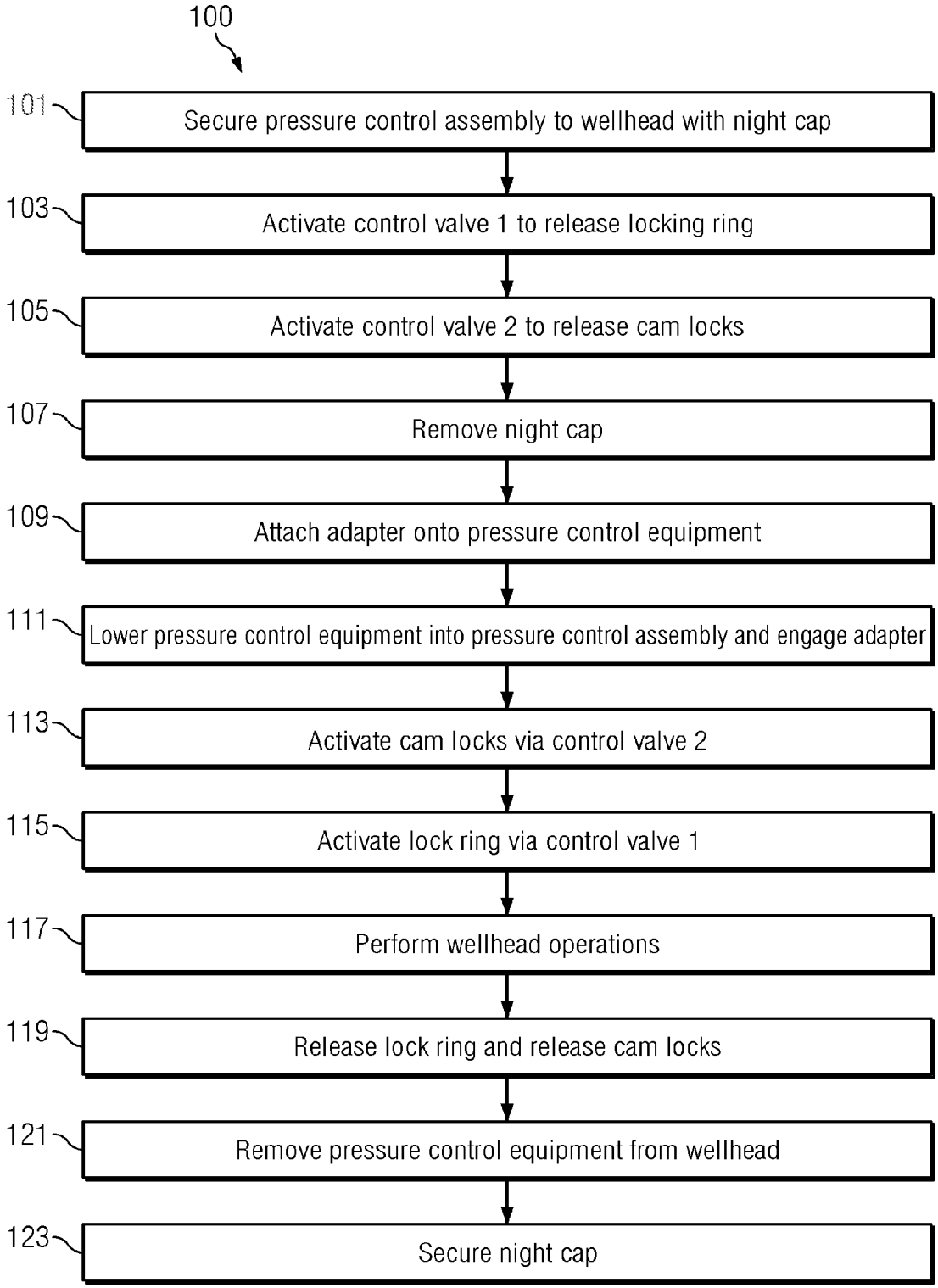
FIG. 1 is a flow chart illustrating method 100, describing in summary the engagement and disengagement of currently preferred embodiments of the disclosed pressure control apparatus.

FIG. 1 is a flow chart illustrating a method 100, describing in summary the steps to be followed in engaging the disclosed pressure control apparatus onto a wellhead prior to pressure control operations, and then disengaging the apparatus after the pressure control operations. It should be noted that the embodiment of method 100 illustrated on FIG. 1 makes use of a night cap option, as will be further described immediately below. In other embodiments of method 100 where the night cap option is not used (such embodiments not illustrated), it will be appreciated that the method steps in which the night cap would otherwise be used will either be simply not performed, or adapted in such a way not to use a night cap.

Referring now to FIG. 1, In blocks 101 through 107, the wellhead and the pressure control equipment ("PCE") to be in pressure communication with the wellhead are prepared for use of the disclosed pressure control apparatus. A pressure control assembly is secured to the top of the wellhead via conventional a flange bolt connection or similar (block 101). When the night cap option is provided, the pressure control assembly is secured to the well head in block 101 with the night cap already secured to the assembly via cam locks and a locking ring, as will be described below with reference to FIGS. 12 and 13. In order to remove the night cap (block 107), a first control valve is activated to release the locking ring (block 103), and then a second control valve is activated to release the cam locks (block 105). The details of locking ring/cam lock release and engagement will be described below. It will be understood that activation of first and second control valves is advantageously done remotely. As will be also seen in further Figures, the pressure control assembly resents a receptacle for receiving a customized adapter on the PCE side. The adapter is secured to the PCE in block 109. The PCE is then lowered onto/into the pressure control assembly such that the adapter engages within its receptacle (block 111).

With further reference to FIG. 1, the disclosed pressure control apparatus's sealing mechanism may then be remotely engaged. First, by remote hydraulic actuation, and as illustrated in block 113, the second control valve opens and causes cam lock pistons to extend, causing rotation of cam locks. Rotation of the cam locks moves them into an engaged position whereby they forcibly bear down on a shoulder on the adapter (as received into its receptacle). Rotation of the cam locks thus has the effect of pressure sealing the connection between the wellhead and the PCE. Then, again by remote hydraulic actuation, the first control valve opens and causes locking ring pistons to retract, causing a locking ring to move into position over the cam locks and retain them in the engaged position (block 115). The locking ring acts primarily a safety device to prevent the cam locks from unintentionally becoming disengaged in the event of, for example, a loss of hydraulic pressure.

Figure 12:
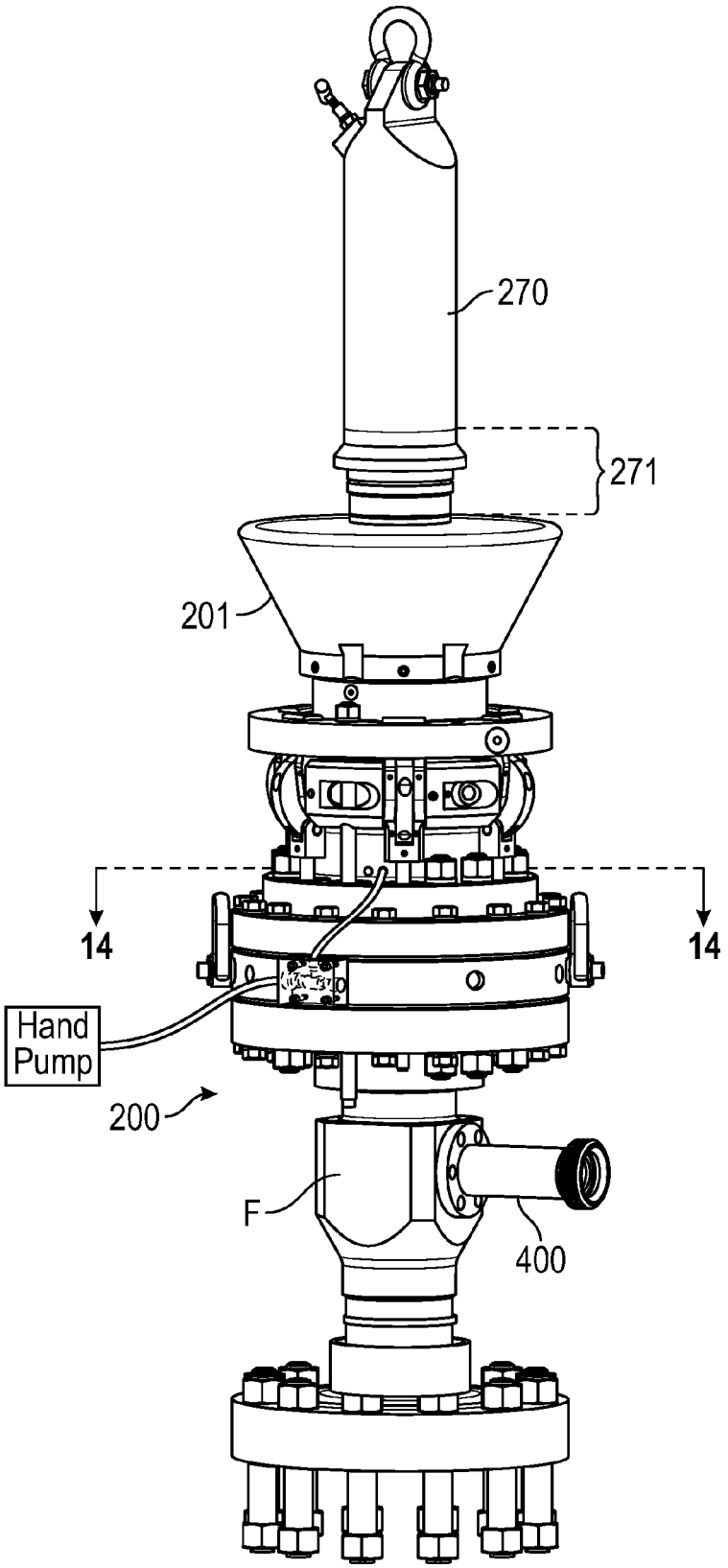
Figure 13:
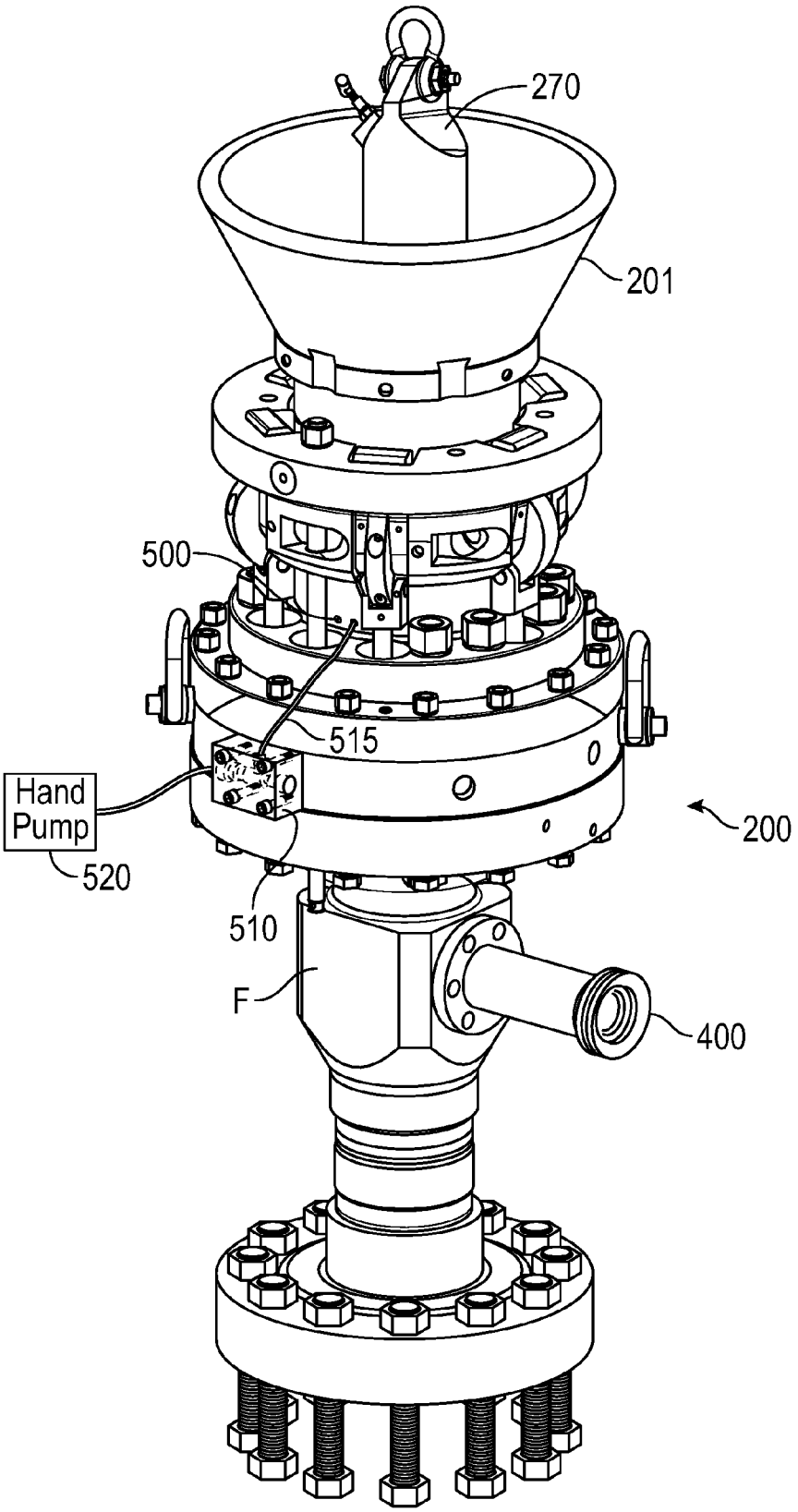

As further shown on FIG. 1, the PCE is now pressure sealed to the wellhead via the disclosed pressure control apparatus and wellhead operations may be conducted (block 117). When wellhead operations are complete, the apparatus may be disengaged remotely by essentially reversing the previous steps (block 119). First, the locking ring pistons are extended causing the locking ring move away from the cam locks, thereby freeing the cam locks to rotate again. Then the cam lock pistons are retracted, causing the cam locks to rotate in the opposite direction so as to disengage from the shoulder on the adapter (fitted to the PCE). The PCE may then be removed from the wellhead (block 121) by withdrawing the adapter (fitted to the PCE) from its receptacle. When the night cap option is provided, the night cap may then be secured again to the pressure control assembly (block 123). Securement of the night cap is essentially the reverse of the steps illustrated in blocks 103 and 105, and a repeat of the steps illustrated on blocks and 113 and 115, except on the night cap instead of adapter fitted to the PCE. Refer below to FIGS. 12 and 13 and associated disclosure for further details.

Figure 2:
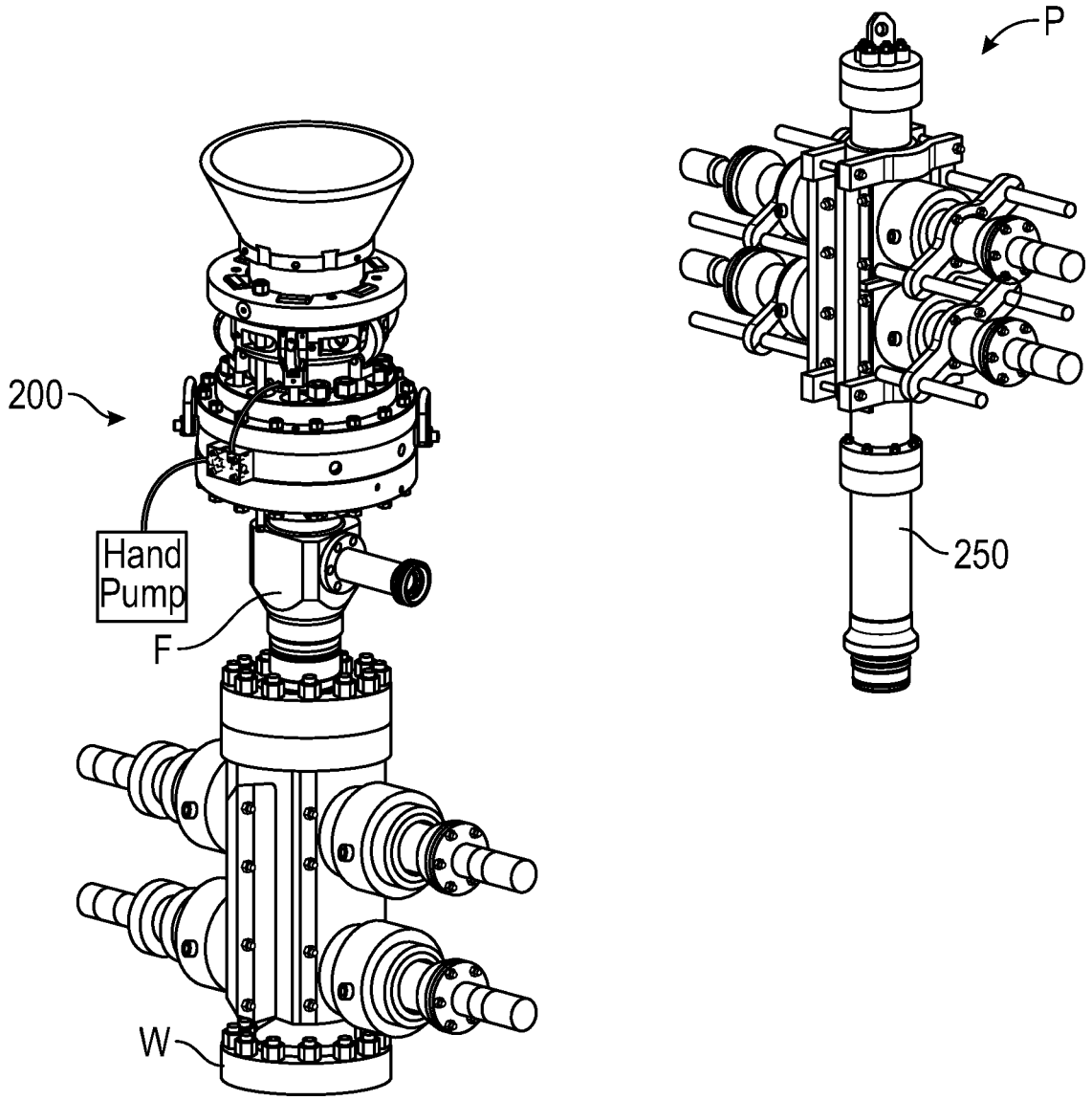

FIGS. 2 through 11 are a freeze-frame series of illustrations depicting a first embodiment of method 100 on FIG. 1 in more detail. In FIG. 2, pressure control equipment ("PCE") is labeled generally as P, and wellhead is labeled generally as W. Pressure control assembly 200 is secured to wellhead W via a conventional bolted flange, although this disclosure is not limited in this regard. The wellhead end of pressure control assembly 200 advantageously provides a customized fitting F to connect to wellhead W. Adapter 250 is secured to PCE P via conventional threading, although again this disclosure is not limited to a threaded connection between PCE P and adapter 250.

Figure 3:
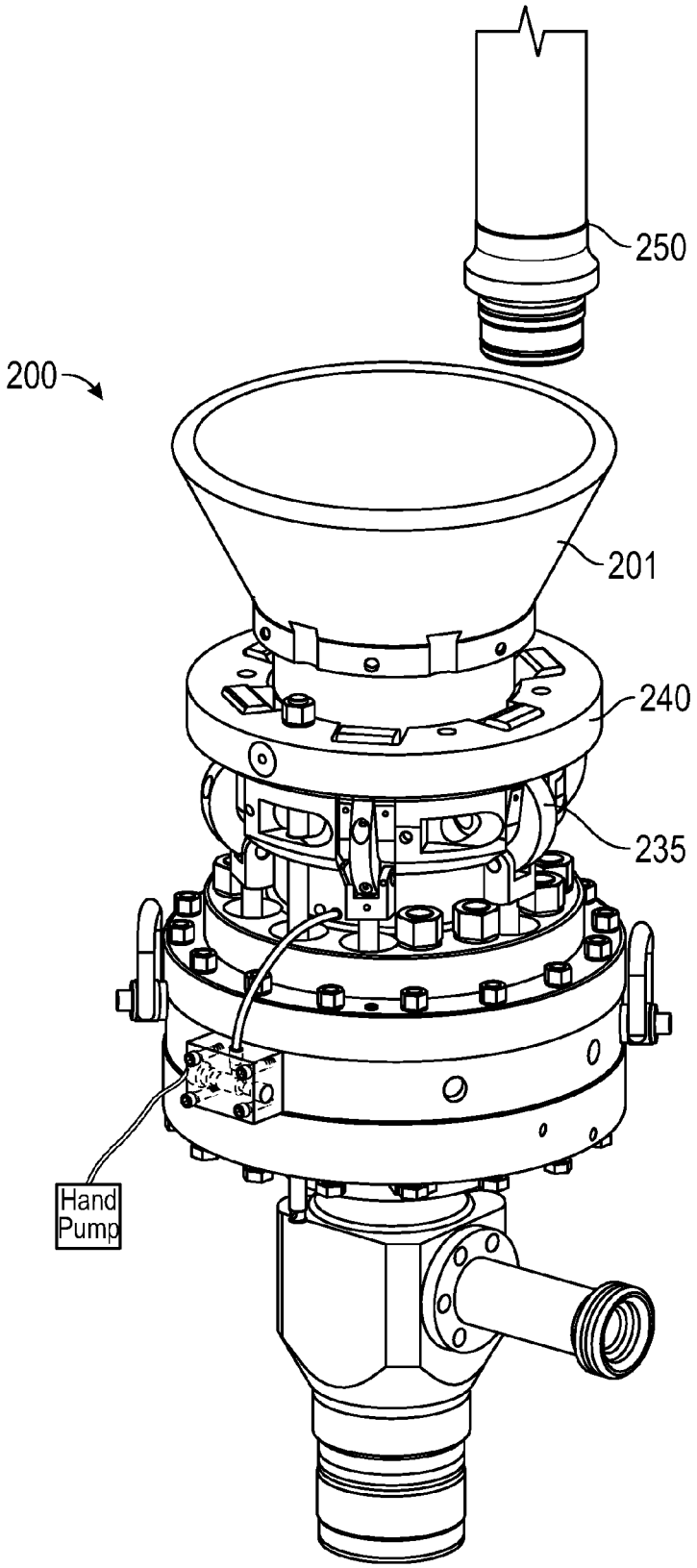

In FIG. 3, PCE has been lifted and moved over pressure control assembly 200 using, for example, a conventional crane (not shown). Entry of adapter 250 into pressure control assembly 200 is facilitate by tulip 201, a conically-shaped piece. For reference, locking ring 240 and link arms 235 are also visible on FIG. 3.

Figure 4:
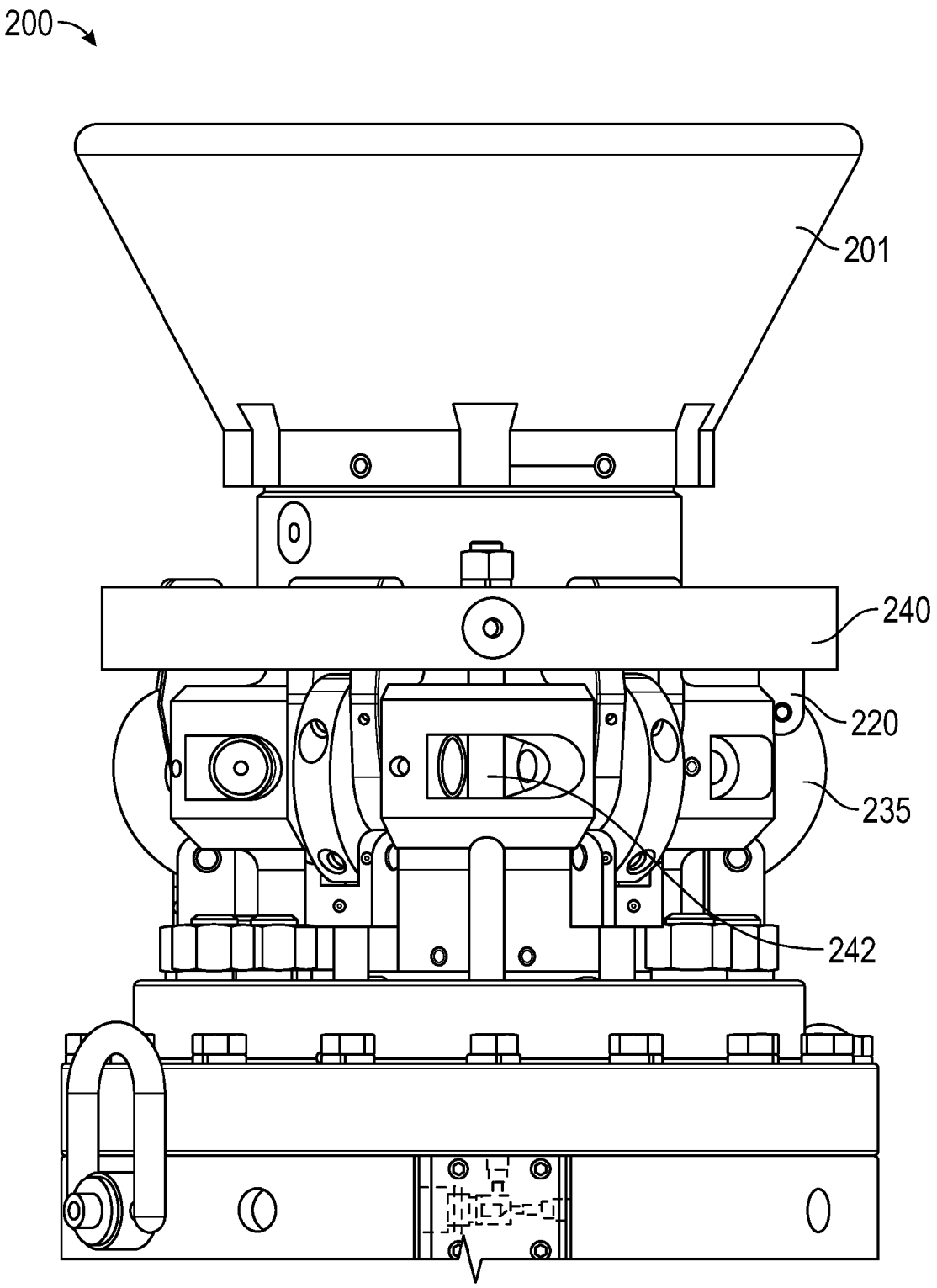

FIG. 4 is an elevation view of a top portion of pressure control assembly 200 in more detail. Tulip 201, locking ring 240, link arms 235 and cam locks 220 are visible. It will be appreciated that on FIG. 4, locking ring 240 and cam locks 220 are in their disengaged position. One of locking ring pistons 242 is also visible on FIG. 4 in a partially extended state. Locking ring pistons 242 are preferably conventional hydraulic pistons, and will be illustrated and described in more detail further on.

Figure 5:
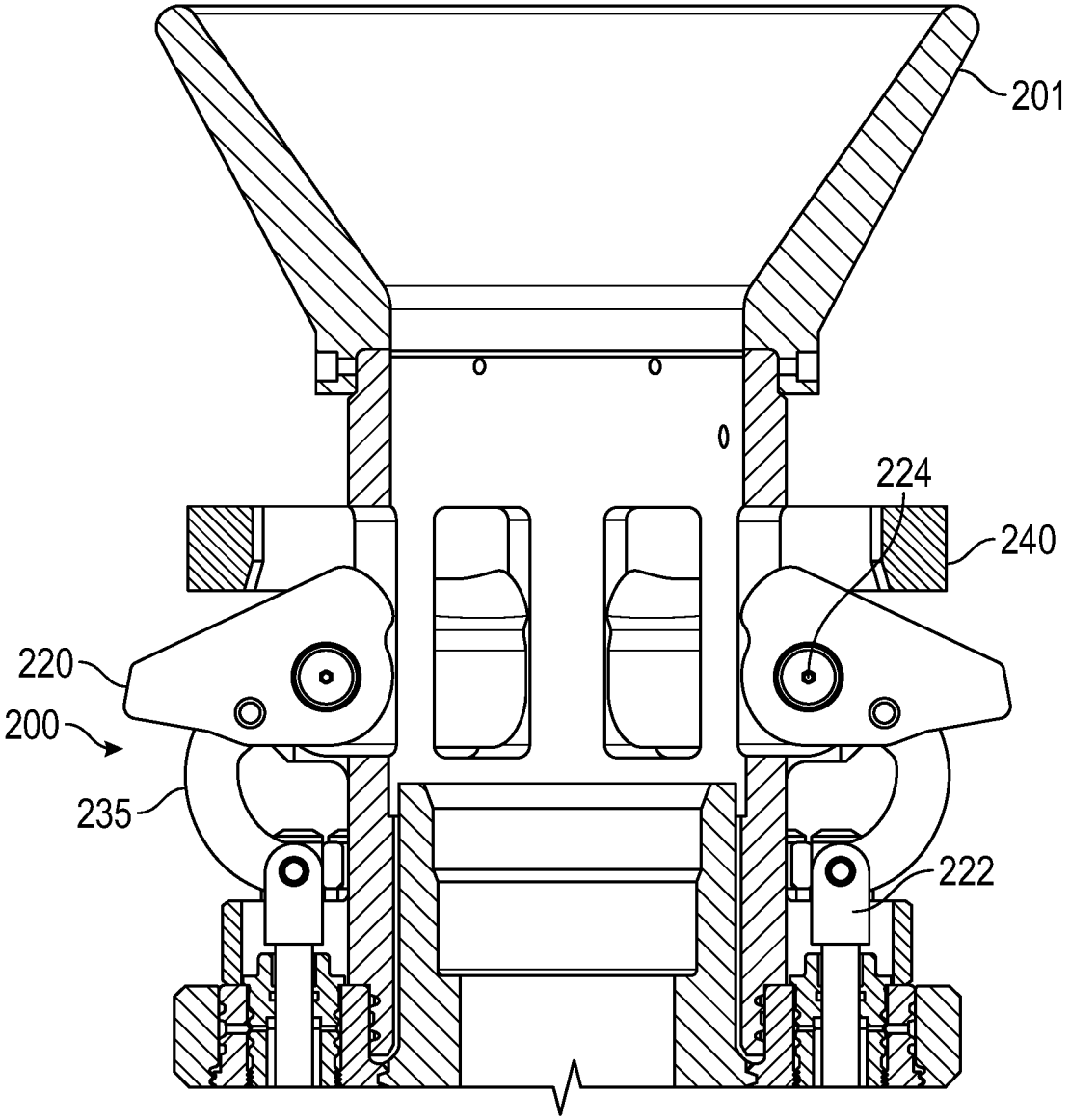

FIG. 5 is the elevation of FIG. 4, except in partial cutaway view to illustrate more clearly the component parts of pressure control assembly 200. Tulip 201, locking ring 240, cam locks 220, link arms 235 and cam lock pistons 222 are all visible on FIG. 5. It will also be appreciated that cam lock pistons 222, link arms 235 and cam locks 220 together form a pinned linkage in which extension and retraction of cam lock pistons 222 will cause cam locks 220 to rotate about cam lock pins 224. Cam lock pistons 222 are preferably conventional hydraulic pistons.

Figure 6:
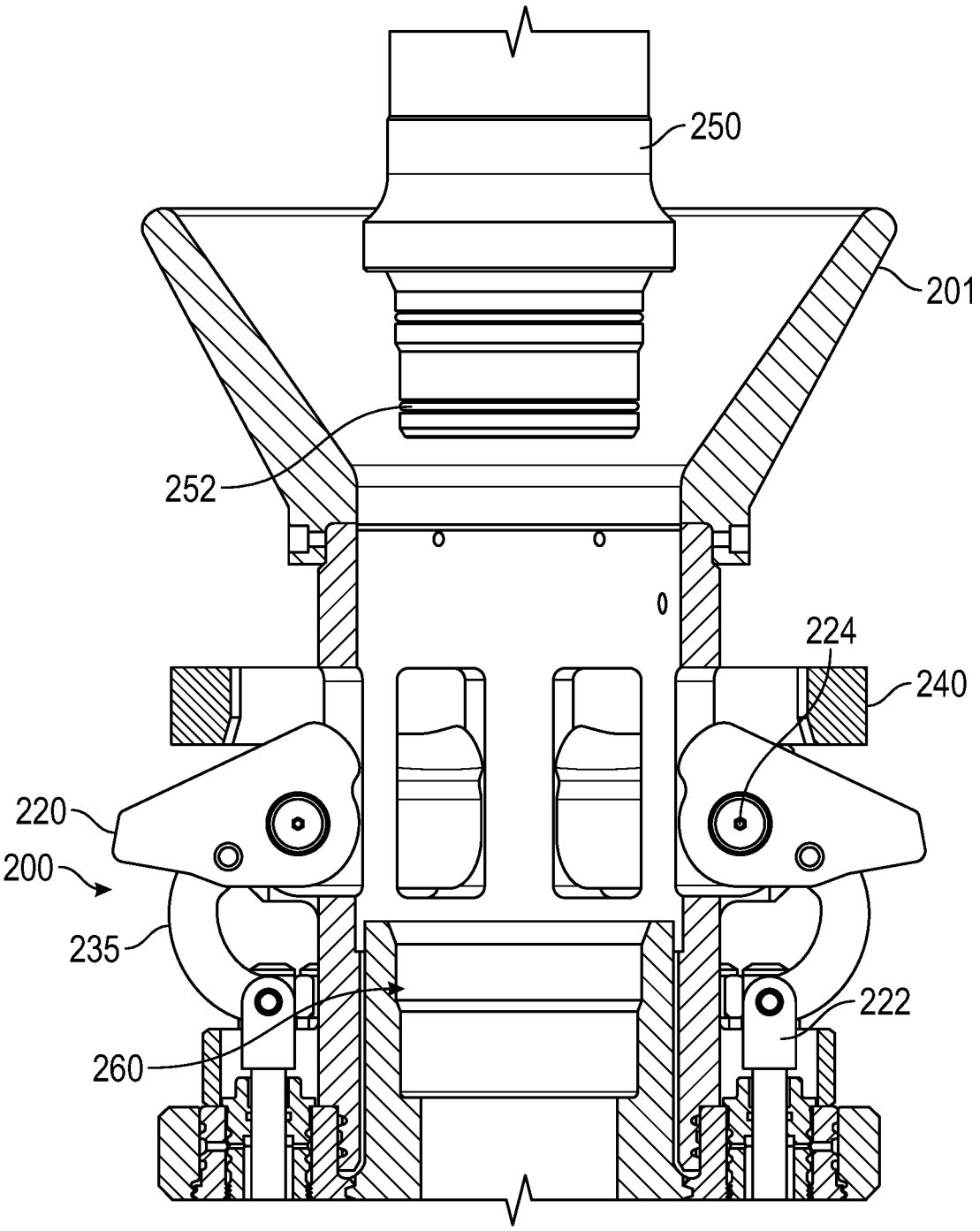

FIG. 6 shows adapter 250 (attached to PCE) entering pressure control assembly 200 with the assistance of tulip 201. Receptacle 260 for adapter 250 is also illustrated, waiting to receive adapter 250. Conventional o-rings 252 are visible on adapter 250.

Figure 7:
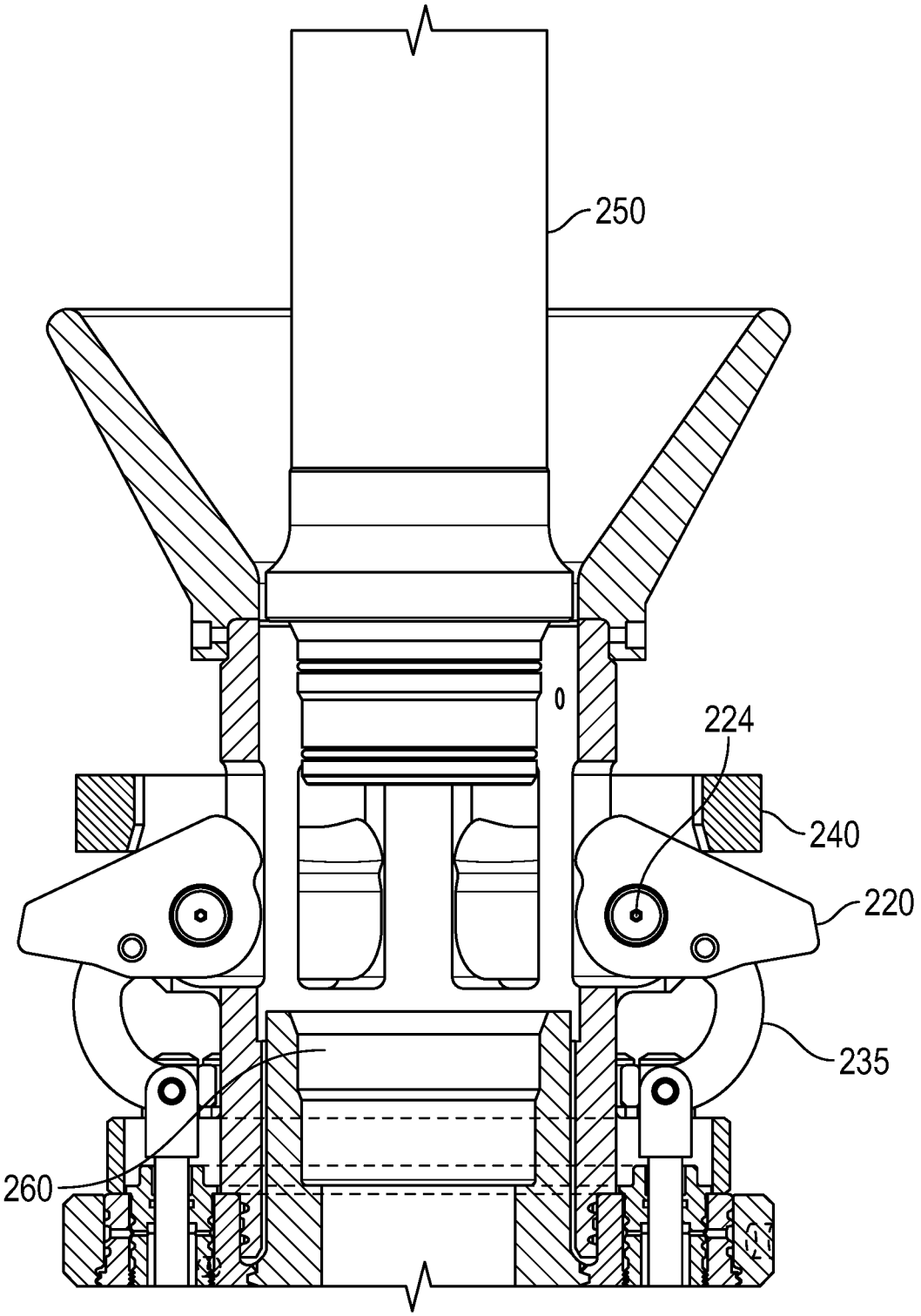
Figure 8:
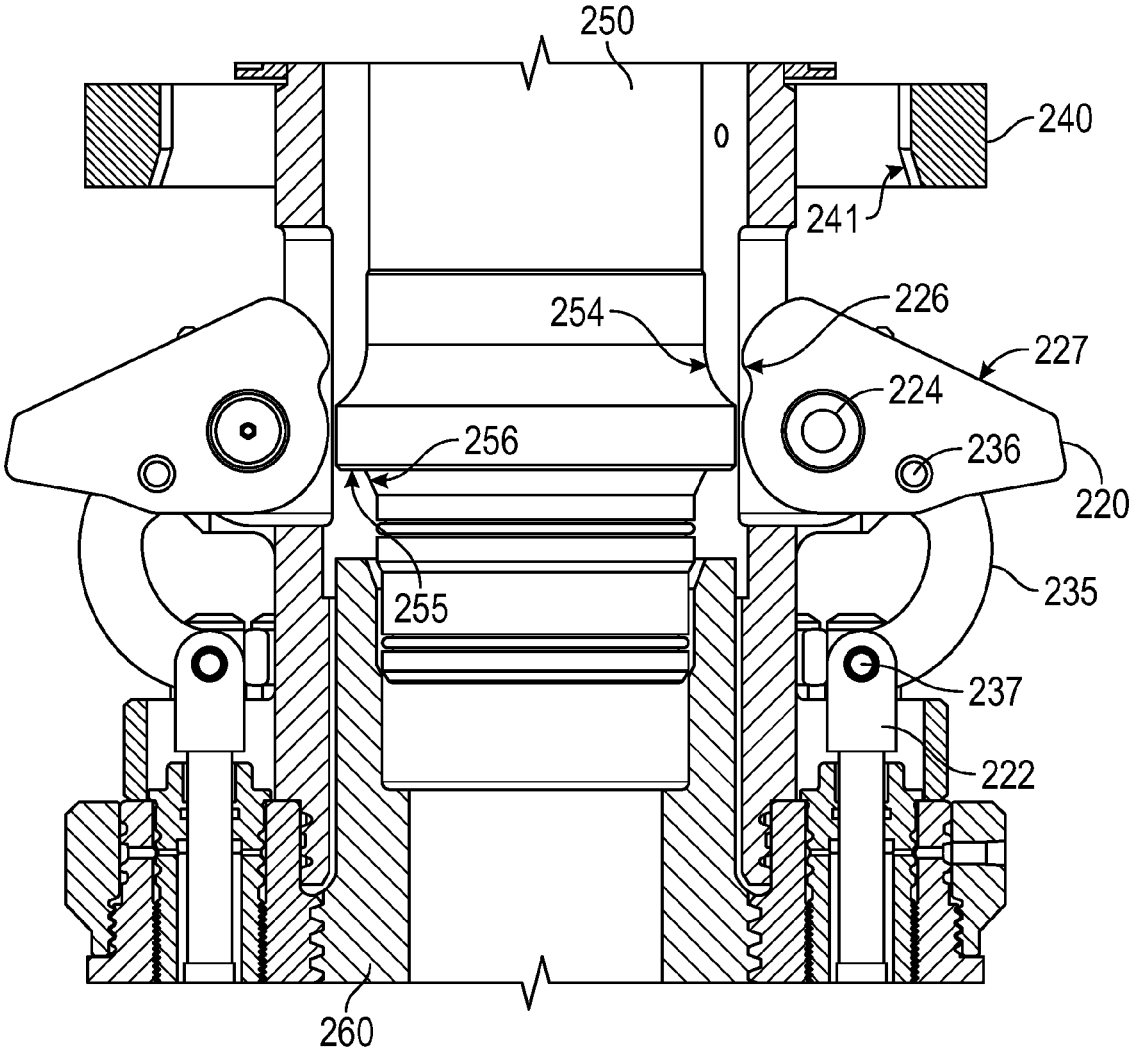
Figure 9:
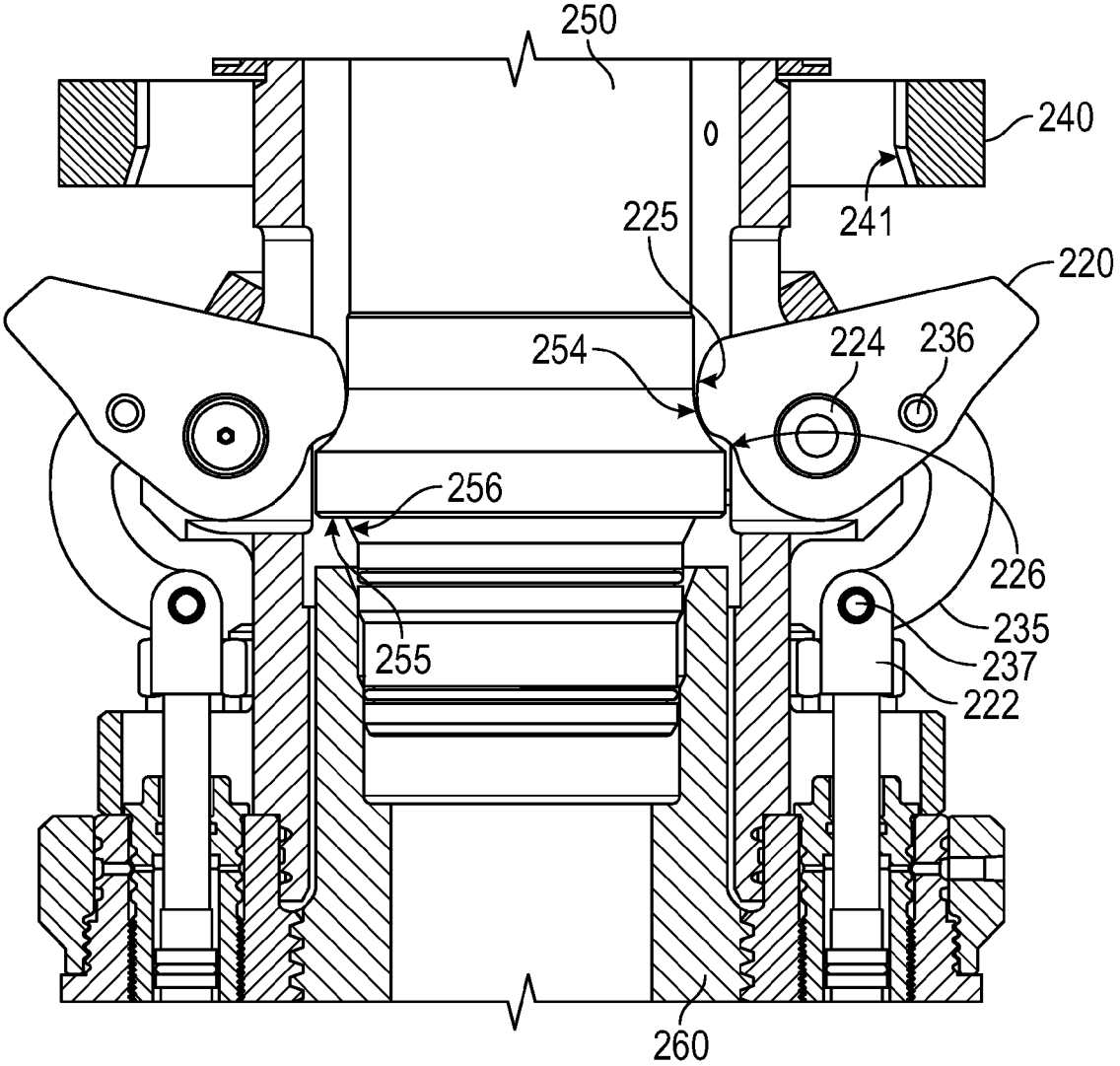
Figure 10:
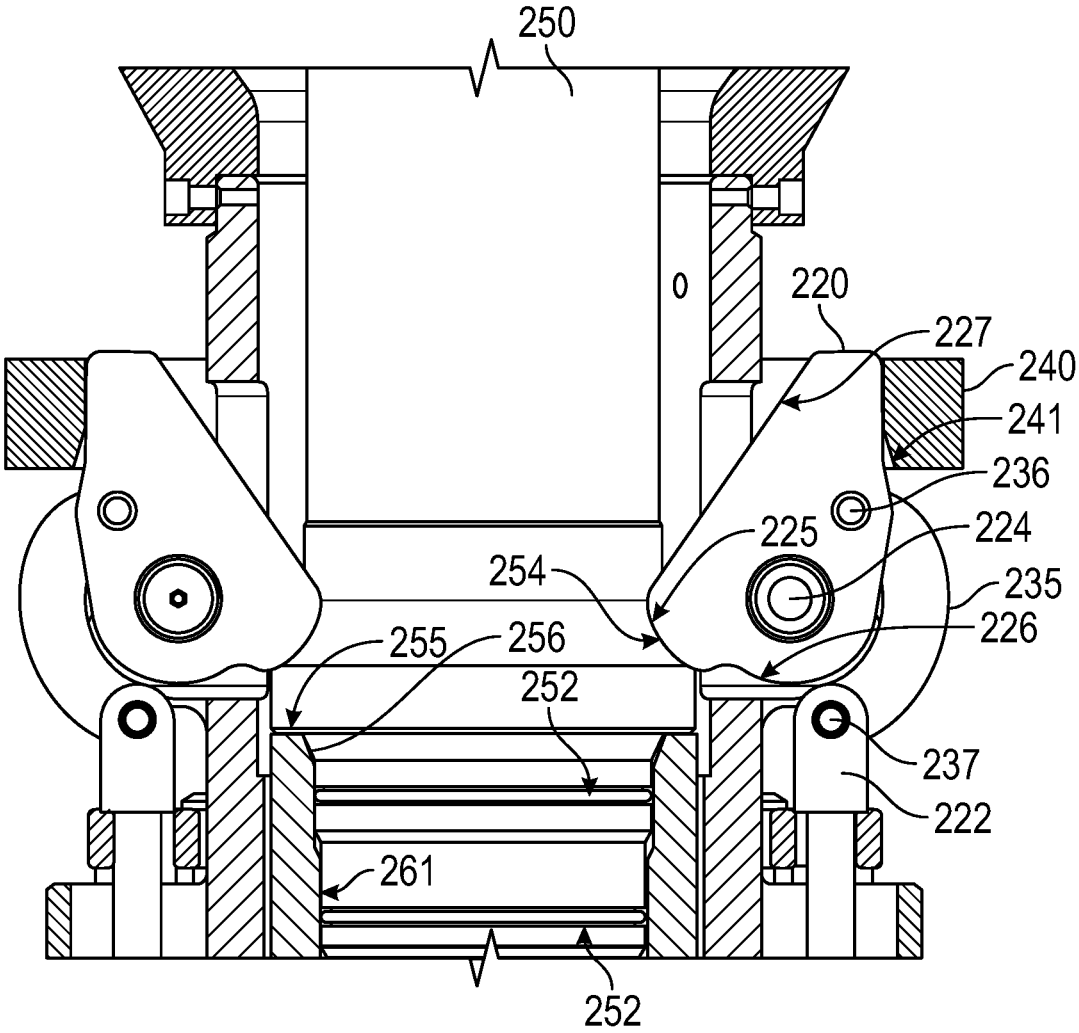

FIG. 7 is the view of FIG. 6 except that adapter 250 is moving closer to its seat in receptacle 260. FIGS. 8 through 10 are magnified freezeframe views as adapter 250 engages its seat in receptacle 260. As will be described in greater detail further on, FIGS. 8 and 9 depict noteworthy features regarding the seating of adapter 250 in receptacle 260. First, adapter 250 is engineered to fit in receptacle 260 so as to provide a high pressure seal when the connection is in compression. Second, shoulder 254 on adapter 250 presents a curvature that is shaped and located to match a corresponding cam curvature 225 (refer FIG. 9) on cam locks 220. As cam locks 220 rotate responsive to extension of cam lock pistons 222, cam curvatures 225 on cam locks 220 engage shoulder 254 and compress adapter 250 into receptacle 260.

On FIGS. 8 and 9, locking ring 240 has been moved away from cam locks 220 via full extension of locking ring pistons 242 (pistons 242 are not shown on FIGS. 8 and 9, see FIG. 4 instead). FIGS. 8 and 9 also illustrate the cam lock linkage in more detail, discussed above with reference to earlier Figures. With particular reference to FIG. 9, it will be seen that cam locks 220 are disposed to rotate about cam lock pins 224. Cam locks 220 each present cam curvatures 225. Cam locks 220 are in pinned linkage connection to cam lock pistons 222 via link arms 235, and first and second linkage pins 236 and 237.

Referring now to FIG. 8, cam locks 220 provide cam lock notches 226 in order to assist capture of shoulder 254 on adapter 250. With reference now to FIGS. 9 and 10, it will be seen that once cam lock notches 226 have engaged shoulder 254, further rotation of cam locks 220 around cam lock pins 224 encourages snug engagement of cam curvatures 225 on shoulder 254 in order to provide a high pressure seal. The relative dimensions, geometries, locations in space, and paths of travel of cam lock pistons 222, first and second linkage pins 236 and 237, link arms 235, cam locks 220, cam lock pins 224, cam lock notches 226 and cam curvatures 225 are all selected, designed and engineered to cooperate with corresponding selections of dimensions and geometries on shoulder 254, seat surface 255 and slope surface 256 on adapter 250 interfacing with receptacle 260, all to bring about a high-pressure seal via compression of adapter 250 into receptacle 260. In preferred embodiments, there is about a 5-thousandths of an inch (0.005") clearance between the exterior cylindrical surface of adapter 250 and the interior cylindrical surface of receptacle 260. This clearance allows for a pressure-controlling seal with o-rings 252. Further, as will be seen on FIGS. 8 through 10, adapter 250 provides machined surfaces on seat surface 255 and slope surface 256. Receptacle 260 also provides corresponding machined surfaces shaped to match seat surface 255 and slope surface 256. Compression of adapter 250 into receptacle 260 thus enables a machined surface metal-to-metal seal at seat surface 255 and slope surface 256. This metal-to-metal seal is engineered to contain high pressures—up to about 15,000 psi MAWP in preferred embodiments. However, with reference to the cooperating abutment surfaces at the interface of adapter 250 and receptacle 260, it will appreciated that the scope of this disclosure is not limited to embodiments providing a machined surface metal-to-metal seal at seat surface 255 and slope surface 256, and that other embodiments may provide other suitable sealing arrangements.

With continuing reference to FIGS. 8 and 9, and moving on to FIG. 10, the operation of cam locks 220 to compress adapter 250 into receptacle 260 is illustrated, thereby enabling the high pressure seal discussed above. On FIG. 8, adapter 250 is entering receptacle 260. Cam lock pistons 222 are fully retracted, and cam curvatures 225 are disengaged. On FIG. 9, extension of cam lock pistons 222 has begun, causing rotation of cam locks 220 about cam lock pins 224 such that cam lock notches 226 have assisted capture of shoulder 254 on adapter 250. On FIG. 10, cam lock pistons 222 are fully extended. The pinned linkage of cam locks 220 to cam lock piston 222 (via link arm 235 and first and second linkage pins 236 and 237) will be seen to have translated the extension of cam lock pistons 222 into rotation of cam locks 220 about cam lock pins 224. Rotation of cam locks 220 about cam lock pins 224 brings cam curvatures 225 to bear on shoulder 254 on adapter 250. Cooperating abutment surfaces at the contact interface of adapter 250 and receptacle 260 are compressed together to form a high pressure seal.

Referring now to FIG. 10, it will be seen that the linkage between cam locks 220, link arms 235 and cam lock pistons 222 is configured so that when cam locks 220 are fully engaged on shoulder 254, locking ring 240 may be lowered to engage cam locks 220. Engagement of cam locks 220 by locking ring 240 is via full retraction of locking ring pistons 242 (pistons 242 are not shown on FIG. 10, see FIG. 4 instead). Cam locks 220 also provide cam lock tapers 227 in order to assist capture of cam locks 220 by locking ring 240. With continuing reference to FIG. 10, it will be seen that as locking ring 240 is lowered to retain and secure cam locks 220 in an engaged position on shoulder 254, corresponding locking ring tapers 241 on locking ring 240 cooperate with cam lock tapers 227 to assist engagement of locking ring 240 on cam locks 220. In preferred embodiments, locking ring 240 may be shaped and sized to provide an interference fit between itself and cam locks 220 to retain and secure them once fully engaged on cam locks 220.

The action of locking ring 240 to secure cam locks 220 is primarily for safety purposes, to prevent cam locks 220 from becoming disengaged from shoulder 254 on adapter 250 in the event of a loss in hydraulic pressure (or otherwise) potentially compromising the high-pressure seal between adapter 250 and receptacle 260. However, it will be appreciated from the immediately preceding paragraphs that the interference fit between locking ring 240 and cam locks 220 also enables, as a secondary effect, an additional "squeezing" force on cam locks 220 when fully engaged on shoulder 254 on adapter 250.

It will be appreciated that in preferred embodiments, extension and retraction of cam lock pistons 222 and locking ring pistons 242 may be done by remote hydraulic operation, fulfilling one of the technical advantages of the disclosed pressure control apparatus as discussed earlier in this disclosure. It will be further appreciated that the "engineered motion and fit" of the cooperating parts as illustrated on FIGS. 8 through 10 are not limited any particular embodiment that might generate a high-pressure seal for a certain size or model of the disclosed pressure control apparatus. It will be appreciated that, consistent with the scope of this disclosure, many such "engineered motion and fit" arrangements may be selected and designed for different sizes or models in which the disclosed pressure control apparatus may be embodied.

Figure 11:
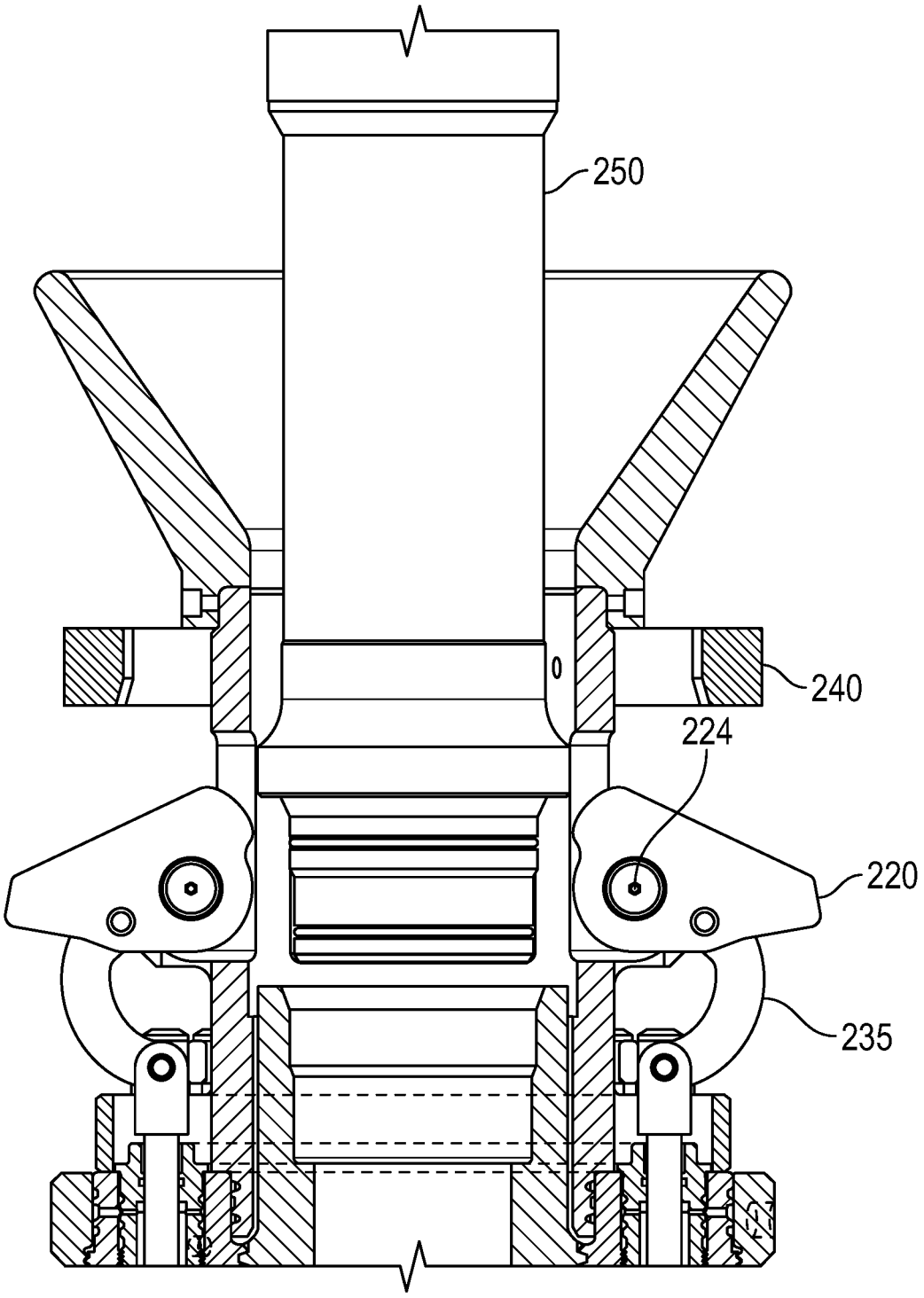

FIG. 11 illustrates disengagement of the disclosed pressure control apparatus. The mechanism is essentially the reverse of engagement, described above with reference to FIGS. 6 through 10. Extension of locking ring pistons 242 (refer FIG. 4) disengages locking ring 240 from cam locks 220, enabling release of cam locks 220. Retraction of cam lock pistons 222 causes cam locks 220 to rotate around cam lock pins 224 and release cam curvatures 225 from shoulder 254 on adapter 250. Adapter 250 may then be withdrawn from receptacle 260. It will be appreciated from FIG. 11 that when cam locks 220 are in a disengaged state, locking ring 240 advantageously does not make contact with cam locks 220. This separation between locking ring 240 and disengaged cam locks 220/link arms 235 applies whether locking ring pistons 242 (refer FIG. 4) are in an extended or retracted state.)

Referring now to commonly invented, commonly-assigned U.S. provisional patent application Ser. No. 62/263,889, incorporated herein by reference, FIGS. 2 through 13 in 62/263,889 are a freeze-frame series of illustrations depicting a second embodiment of method 100 on FIG. 1 in more detail. The second embodiment of method 100, as illustrated on FIGS. 2 through 13 of 62/263,889, is very similar to the embodiment depicted on FIGS. 2-11 in this disclosure, except that, primarily, (1) cam locks 220 in 62/263,889 are shaped more smoothly and do not provide a notch corresponding to cam lock notches 226 in this disclosure, (2) locking ring 240 in 62/263,889 is shaped and configured to be received onto link arms 235 in 62/263,889 rather than directly onto cam locks 220 in this disclosure, and (3) the geometry of the linkage (and path of travel of the linked components) for cam locks 220, link arms 235 and cam lock pistons 222 in 62/263,889 is different than in this disclosure.

While both the embodiment disclosed in FIGS. 2 through 13 in 62/263,889 (and associated text) and the embodiment described with reference to FIGS. 2 through 11 in this disclosure are serviceable, the embodiment described in this disclosure is currently preferred. Comparison of the performance of prototypes of each embodiment has shown that the embodiment described in this disclosure demonstrated improved pressure retention in the seal created via compression of adapter 250 into receptacle 260. Prototypes of each embodiment on 5.125" internal diameter bores were pressure tested. In the embodiment disclosed in FIGS. 2 through 13 of 62/263,889 (and associated text), design was for about a 5,000 psi MAWP using a 7,500 psi test pressure. The ultimate destruction load was in fact just under 15,000 psi. In the embodiment described in this disclosure with reference to FIGS. 2 through 11 herein, design was for about 10,000 psi MAWP with a 15,000 psi test load. Testing towards to ultimate destruction load was up to 17,500 psi without failure.

As has been described previously, the disclosed pressure control apparatus is available with a separate night cap option. Blocks 101-107 and 123 in method 100 on FIG. 1 make reference to the night cap (when the night cap option is used), and are described in general in the disclosure above associated with FIG. 1. FIGS. 12 and 13 illustrate release and engagement of the night cap (as described with reference to FIG. 1) in more detail. FIGS. 12 and 13 illustrate night cap 270 entering tulip 201 and preparing to be engaged on pressure control assembly 200. FIG. 12 illustrates engagement portion 271 on night cap 270. Engagement portion 271 has functionally identical structure to that seen on adapter 250 on, for example, FIG. 8. FIG. 8 illustrates shoulder 254, seat surface 255 and slope surface 256 on adapter 250 interfacing with receptacle 260 on pressure control assembly 200 to provide a high pressure seal when cam locks 220 and locking ring 240 are engaged. Likewise, engagement portion 271 on FIG. 12 provides functionally identical features on night cap 270 so that night cap 270 can engage with receptacle 260 in the same way as adapter 250 engages with receptacle 260, via formation of a high pressure seal through engagement of cam locks 220 and locking ring 240. FIG. 13 depicts night cap secured into pressure control assembly 200 in the manner just described.

It will also be seen on FIGS. 12 and 13 that night cap 270 advantageously provides a shackle or other conventional lifting attachment. This feature enables lifting apparatus (such as a crane) to attach to night cap 270 while secured in pressure control assembly 200, providing a convenient hitch point and lifting connection for the entire pressure control apparatus. This feature thus facilitates, for example, lowering/raising of the entire apparatus during connection or disconnection from the well head, or between the wellhead and other transportation.

FIGS. 12 and 13 further depict vent line 400 provided in fitting F, as previously described above with reference to FIG. 2. In currently preferred embodiments, vent line 400 provides no internal mechanisms, and acts as a simple, conventional relief line with suitable connection fittings at either end (e.g. bolted flange, o-ring or threaded connection). Vent line 400 allows fluid under pressure in pressure control assembly 200 above wellhead W to be relieved and drained at such times as, for example, during removal of pressure control assembly 200 from wellhead W.

Figure 14:
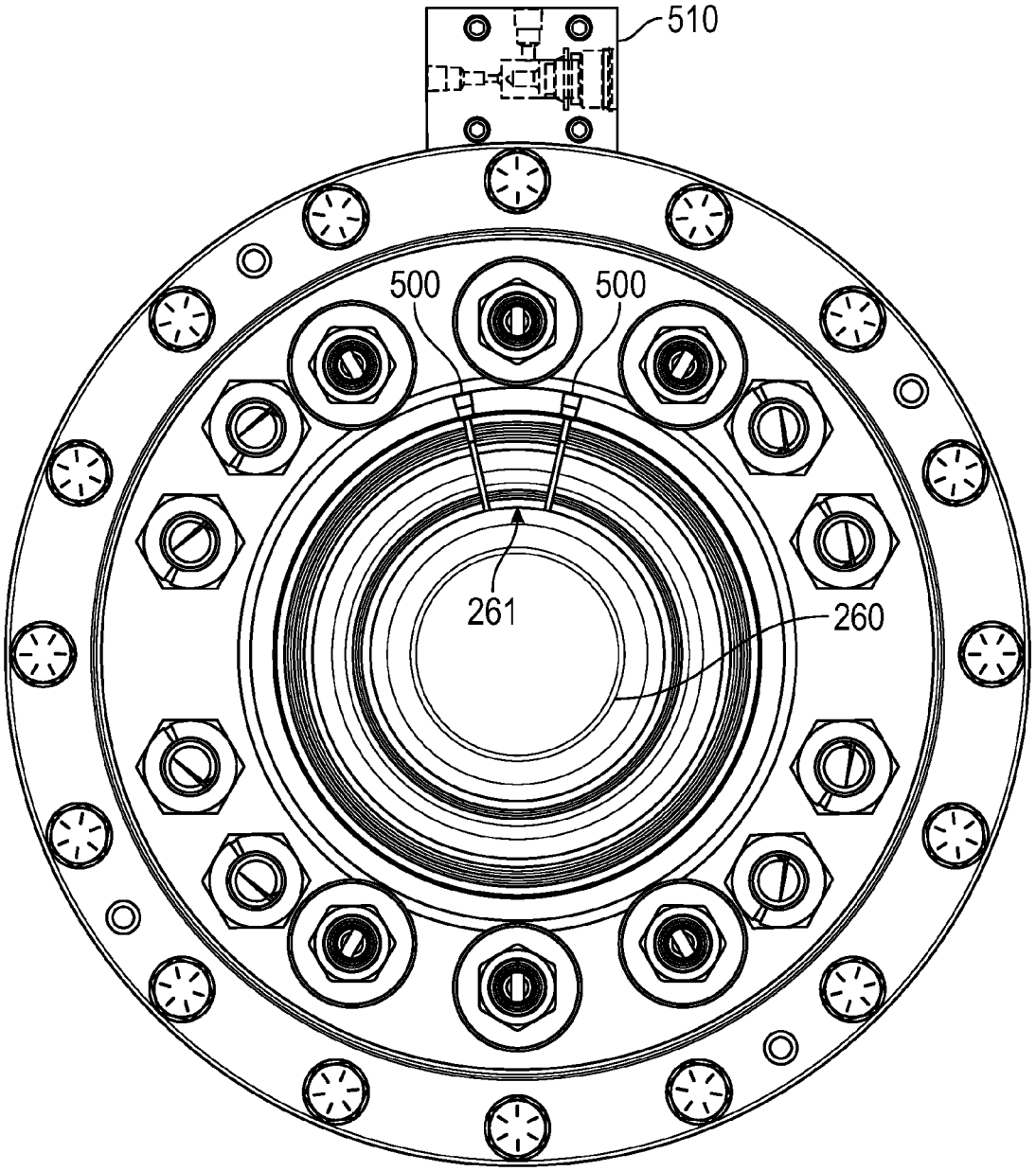
Figure 15:
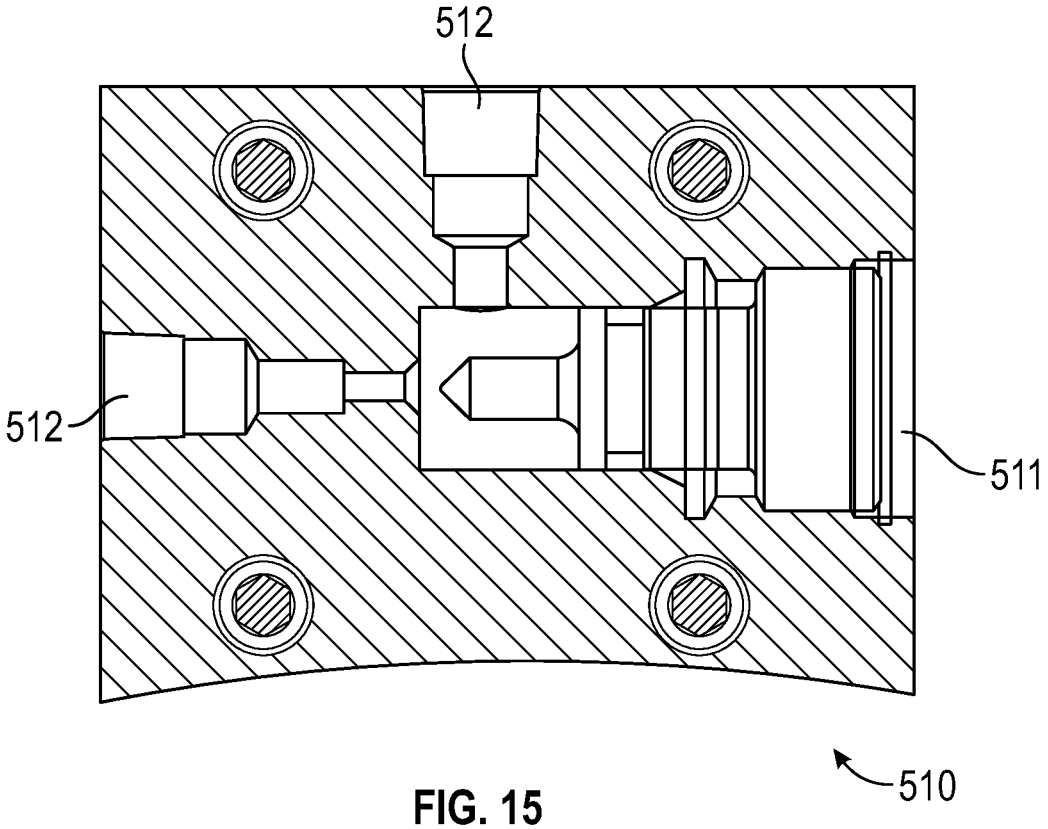

FIGS. 13 through 15 depict quick test ports 500 and associated manifold box 510 provided on pressure control assembly 200. FIG. 13 shows quick test ports 500 and manifold box 510 as seen from the outside of pressure control assembly 200. A conventional high pressure hydraulic hose 515 connects manifold box 510 to one of the quick test ports 500. As shown on FIG. 13, a conventional hydraulic hand pump 520, preferably operated remotely, injects fluid into manifold box 510 under pressure, and then, via hose 515, through to one of the quick test ports 500. It will be appreciated that although FIG. 13 illustrates a currently preferred embodiment in which two quick test ports 500 are provided. The scope of this disclosure is not limited in this regard, and any number may be provided. However, only one will be in operation at any time. Quick test ports 500 that are not in operation are sealed with threaded plugs for future use. The purpose of providing redundant quick test ports 500 is in case one or more become damaged during service, and have to be permanently sealed. In presently preferred embodiments, quick test ports 500 are preferably 1/16" in diameter, although the scope of this disclosure is not limited in this regard.

FIG. 14 is a section as shown on FIG. 12, cutting through pressure control assembly 200 at the centerline elevation of quick test ports 500 (refer FIG. 13). FIG. 14 depicts quick test ports 500 providing fluid passageways from the outside of pressure control assembly 200 through to the interior of receptacle 260 along interior portion 261. Quick test ports 500 further preferably provide fluid passageways to the interior of receptacle 260 at elevations between o-rings 252 when, as shown on FIG. 10, adapter 250 is fully compressed into receptacle 260 by cam locks 220 and the desired high pressure connection between adapter 250 and receptacle 260 is formed.

With continuing reference to FIG. 10, it will be seen that interior wall portion 261 of receptacle 260 engages adapter 250 between o-rings 252 when adapter 250 is received operationally into receptacle 260. It will be further appreciated that when high pressure fluid is introduced from beneath receptacle 260, the seals created by o-rings 252 will restrict or impede the ability of fluid to enter the engagement of adapter 250 with receptacle 260 along interior wall portion 261.

Returning now to FIGS. 13 and 14, it will be seen that quick test port 500 enables fluid, pumped by hand pump 520 and delivered via manifold box 510 and hose 515, to be introduced into the engagement of adapter 250 with receptacle 260 along interior wall portion 261, thereby equalizing the pressure between o-rings 252 when high pressure fluid is introduced from beneath receptacle 260.

Conversely, it will be appreciated that upon removal of adapter 250 from receptacle 260, the seals created by o-rings 252 will restrict or impede the ability of fluid to depressurize in the engagement of adapter 250 with receptacle 260 along interior wall portion 261. Quick test port 500 enables fluid trapped at pressure between o-rings 252 to be relieved. In other applications, fluid delivered by hand pump 520 through quick test port 500 enables the integrity of the seals provided by o-rings 252 to be checked prior to introducing high pressure fluid into the connection between adapter 250 and receptacle 260.

FIG. 15 is a horizontal section through manifold box 510 illustrating more clearly the details shown in broken lines on, for example. FIGS. 13 and 14. Broadly, it will be appreciated that manifold 510 acts as a needle valve in the fluid line between hand pump 520 and quick test port 500. This needle valve functionality acts as an added failsafe in the hydraulic line, so that pressure may be shut down in the event of an unintended leak during operations. Referring to FIG. 15, manifold box 510 comprises hand pump connection 511. Hand pump connection 511 is conventional, and also provides conventional needle valve functionality which may be actuated to shut down pressure to or from manifold box 510 as required. Manifold box 510 also comprises a plurality of conventional hose connections 512, each in internal fluid communication with hand pump connection 511. As shown on FIG. 13, for example, hose 515 connects one of the hose connections 512 to quick test port 500. Hose connections 512 not in use may be sealed using a conventional threaded plug.

Earlier description made clear that the scope of this disclosure in no way limits the disclosed pressure control apparatus to specific sizes or models. Currently envisaged embodiments make the apparatus available in several sizes, shapes, and pressure ratings to adapt to existing surface pressure control equipment. Proprietary connections may require specialized adapters. It will be nonetheless understood that the scope of this disclosure is not limited to any particular sizes, shapes, and pressure ratings for various embodiments of the disclosed pressure control apparatus, and that the embodiments described in this disclosure and in U.S. provisional patent application Ser. No. 62/263,889 (incorporated herein by reference) are exemplary only.

For example, other embodiments may provide a smaller apparatus, having all the functionality of the disclosed pressure control apparatus embodiments disclosed in detail herein, except with a smaller overall diameter, and correspondingly fewer cam lock assemblies around the periphery. In other embodiments, the pressure control apparatus may provide wedge mechanisms instead of cam lock mechanisms to enable, compress and hold the pressure connection. In yet other embodiments, spring assemblies may supplement the mechanisms compressing and holding the pressure connection.

Currently envisaged embodiments of the disclosed pressure control apparatus may provide pressure ratings including 5,000 psi, 10,000 psi and 15,000 psi MAWP ratings, each further rated for $H_2S$ service. Currently envisaged sizes may range from about 2" to about 7" ID. The foregoing sizes and performance metrics are exemplary only, and the scope of this disclosure is not limited in such regards. It will be appreciated that the number of cam locks and associated linkages/pistons will change with diameter.

Although the pressure control apparatus has been described in this disclosure with reference to an exemplary application in pressure control at a wellhead, alternative applications could include, for example, areas such as deep core drilling, offshore drilling, methane drilling, open hole applications, hydraulic fracturing, wireline operations, coil tubing operations, mining operations, and various operations where connections are needed under a suspended or inaccessible load (i.e., underwater, hazardous area).

Exemplary materials used in the construction of the disclosed pressure control apparatus include high strength alloy steels, high strength polymers, and various grades of elastomers.

Although the inventive material in this disclosure has been described in detail along with some of its technical advantages, it will be understood that various changes, substitutions and alternations may be made to the detailed embodiments without departing from the broader spirit and scope of such inventive material as set forth in the following claims.

We claim:

1. A wellhead pressure control fitting, comprising:

a generally tubular Pressure Control Equipment (PCE) adapter having first and second adapter ends, the first adapter end configured to mate with pressure control equipment, the second adapter end providing a shaped end including an adapter end curvature;

a generally tubular pressure control assembly having first and second assembly ends, the first assembly end providing a first assembly end interior and a first assembly end exterior, the second assembly end configured to mate with a wellhead;

the first assembly end exterior having an exterior periphery, the exterior periphery providing a plurality of cam locks, each cam lock disposed to rotate about a corresponding cam lock pin, each cam lock pin anchored to the first assembly end exterior, each cam lock further providing a cam perimeter curvature;

the first assembly end exterior further providing a plurality of cam lock pistons, one cam lock piston for each cam lock, wherein extension and retraction of the cam lock pistons causes rotation of the cam locks in opposing directions about their corresponding cam lock pins;

the first assembly end exterior further providing a plurality of locking ring pistons, a locking ring connected to the locking ring pistons at a distal end thereof, the locking ring encircling the first assembly end proximate the cam locks, wherein extension of the locking ring pistons causes the locking ring to move to a position free of contact with the cam locks as the cam locks rotate about the cam lock pins, and wherein retraction of the locking ring pistons causes the locking ring to move so as to restrain the cam locks from rotation about the cam lock pins;

the first assembly end interior providing a receptacle for receiving the second adapter end, the second adapter end and the receptacle further each providing cooperating abutment surfaces, the cooperating abutment surfaces forming a high pressure seal between the second adapter end and the receptacle when the second adapter end is compressively received into the receptacle;

wherein, as the second adapter end enters the receptacle and engages the cooperating abutment surfaces, extension of the cam lock pistons causes the cam locks to rotate about the cam lock pins, which in turn causes the cam perimeter curvatures on the cam locks to cooperatively bear down on the adapter end curvature, which in turn compresses the second adapter end into the receptacle to form the high pressure seal; and wherein, once the high pressure seal is formed, retraction of the locking ring pistons causes the locking ring to move so as to restrain the cam locks from rotation about the cam lock pins.

2. The wellhead pressure control fitting of claim 1, in which each cam lock further provides a cam perimeter notch, each cam perimeter notch configured to engage the second adapter end as the second adapter end approaches entry into the receptacle.

3. The wellhead pressure control fitting of claim 1, in which the second assembly end further provides a vent line.

4. The wellhead pressure control fitting of claim 1, in which the second adapter end provides at least one o-ring seal configured to mate with the receptacle when the second adapter end is received into the receptacle.

5. The wellhead pressure control fitting of claim 4, in which the at least one o-ring seal provided by the second adapter end comprises at least first and second o-ring seals, and in which the first assembly end further provides a quick test port, the quick test port comprising a fluid passageway from the first assembly end exterior through to the first assembly end interior, wherein the quick test port is open to the first assembly end interior at a location selected to lie between the first and second o-ring seals when the second end adapter and the receptacle form the high pressure seal.

6. The wellhead pressure control fitting of claim 1, in which the locking ring is in an interference fit with the cam locks when retraction of the locking ring pistons causes the locking ring to move so as to restrain the cam locks from rotation about the cam lock pins.

7. The wellhead pressure control fitting of claim 1, in which each cam lock piston is connected to its corresponding cam lock via a pinned cam linkage, each pinned cam linkage including a link arm interposed between the cam lock piston and cam lock, each link arm connected to the cam lock via a first linkage pin, each link arm connected to the cam lock piston by a second linkage pin.

8. The wellhead pressure control fitting of claim 1, in which the cooperating abutment surfaces include a machined shoulder surface and a machined slope surface provided on the second adapter end, the receptacle further providing machined surfaces to mate with the shoulder surface and slope surface in forming the high pressure seal.

9. The wellhead pressure control fitting of claim 1, in which the PCE adapter is interchangeable with a generally tubular night cap adapter, the night cap adapter having first and second night cap ends, wherein the first night cap end is closed and sealed off against internal pressure, and wherein the second night cap end is dimensionally identical to the second adapter end on the PCE adapter.

10. The wellhead pressure control fitting of claim 1, in which the high pressure seal is able to withstand pressures up to about 15,000 psi MAWP.

11. The wellhead pressure control fitting of claim 1, in which the second adapter end is received into receptacle with about a 0.005" clearance fit.

12. A wellhead pressure control fitting, comprising:

a generally tubular Pressure Control Equipment (PCE) adapter having first and second adapter ends, the first adapter end configured to mate with pressure control equipment, the second adapter end providing a shaped end including an adapter end curvature;

a generally tubular pressure control assembly having first and second assembly ends, the first assembly end providing a first assembly end interior and a first assembly end exterior, the second assembly end configured to mate with a wellhead;

the first assembly end exterior having an exterior periphery, the exterior periphery providing a plurality of cam locks, each cam lock disposed to rotate about a corresponding cam lock pin, each cam lock pin anchored to the first assembly end exterior, each cam lock further providing a cam perimeter curvature;

the first assembly end exterior further providing a plurality of cam lock pistons, one cam lock piston for each cam lock, wherein extension and retraction of the cam lock pistons causes rotation of the cam locks in opposing directions about their corresponding cam lock pins;

the first assembly end interior providing a receptacle for receiving the second adapter end, the second adapter end and the receptacle further each providing cooperating abutment surfaces, the cooperating abutment surfaces forming a high pressure seal between the second adapter end and the receptacle when the second adapter end is compressively received into the receptacle; and wherein, as the second adapter end enters the receptacle and engages the cooperating abutment surfaces, extension of the cam lock pistons causes the cam locks to rotate about the cam lock pins, which in turn causes the cam perimeter curvatures on the cam locks to cooperatively bear down on the adapter end curvature, which in turn compresses the second adapter end into the receptacle to form the high pressure seal.

13. The wellhead pressure control fitting of claim 12, in which each cam lock further provides a cam perimeter notch, each cam perimeter notch configured to engage the second adapter end as the second adapter end approaches entry into the receptacle.

14. The wellhead pressure control fitting of claim 12, in which the second assembly end further provides a vent line.

15. The wellhead pressure control fitting of claim 12, in which the second adapter end provides at least one o-ring seal configured to mate with the receptacle when the second adapter end is received into the receptacle.

16. The wellhead pressure control fitting of claim 15, in which the at least one o-ring seal provided by the second adapter end comprises at least first and second o-ring seals, and in which the first assembly end further provides a quick test port, the quick test port comprising a fluid passageway from the first assembly end exterior through to the first assembly end interior, wherein the quick test port is open to the first assembly end interior at a location selected to lie between the first and second o-ring seals when the second end adapter and the receptacle form the high pressure seal.

17. The wellhead pressure control fitting of claim 12, in which each cam lock piston is connected to its corresponding cam lock via a pinned cam linkage, each pinned cam linkage including a link arm interposed between the cam lock piston and cam lock, each link arm connected to the cam lock via a first linkage pin, each link arm connected to the cam lock piston by a second linkage pin.

18. The wellhead pressure control fitting of claim 12, in which the cooperating abutment surfaces include a machined shoulder surface and a machined slope surface provided on the second adapter end, the receptacle further providing machined surfaces to mate with the shoulder surface and slope surface in forming the high pressure seal.

19. The wellhead pressure control fitting of claim 12, in which the PCE adapter is interchangeable with a generally tubular night cap adapter, the night cap adapter having first and second night cap ends, wherein the first night cap end is closed and sealed off against internal pressure, and wherein the second night cap end is dimensionally identical to the second adapter end on the PCE adapter.

20. A wellhead pressure control fitting, comprising:

a generally tubular Pressure Control Equipment (PCE) adapter having first and second adapter ends, the first adapter end configured to mate with pressure control equipment, the second adapter end providing a shaped end including an adapter end curvature;

a generally tubular pressure control assembly having first and second assembly ends, the first assembly end providing a first assembly end interior and a first assembly end exterior, the second assembly end configured to mate with a wellhead, the first assembly end exterior having an exterior periphery, the exterior periphery providing a plurality of cam locks, each cam lock disposed to rotate about a corresponding cam lock pin, each cam lock pin anchored to the first assembly end exterior, each cam lock further providing a cam perimeter curvature;

the first assembly end exterior further providing a plurality of cam lock pistons, one cam lock piston for each cam lock, wherein extension and retraction of the cam lock pistons causes rotation of the cam locks in opposing directions about their corresponding cam lock pins;

the first assembly end exterior further providing a plurality of locking ring pistons, a locking ring connected to the locking ring pistons at a distal end thereof; the locking ring encircling the first assembly end proximate the cam locks, wherein extension of the locking ring pistons causes the locking ring to move to a position free of contact with the cam locks as the cam locks rotate about the cam lock pins, and wherein retraction of the locking ring pistons causes the locking ring to move so as to restrain the cam locks from rotation about the cam lock pins;

the first assembly end interior providing a receptacle for receiving the second adapter end, the second adapter end providing at least one o-ring seal configured to mate with the receptacle when the second adapter end is received into the receptacle, the second adapter end and the receptacle further each providing cooperating abutment surfaces, the cooperating abutment surfaces forming a high pressure seal between the second adapter end and the receptacle when the second adapter end is compressively received into the receptacle;

wherein, as the second adapter end enters the receptacle and engages the cooperating abutment surfaces, extension of the cam lock pistons causes the cam locks to rotate about the cam lock pins, which in turn causes the cam perimeter curvatures on the cam locks to cooperatively bear down on the adapter end curvature, which in turn compresses the second adapter end into the receptacle to form the high pressure seal;

wherein each cam lock further provides a cam perimeter notch, each cam perimeter notch configured to engage the second adapter end as the second adapter end approaches entry into the receptacle; and wherein, once the high pressure seal is formed, retraction of the locking ring pistons causes the locking ring to move so as to engage the cam locks in an interference fit restraining the cam locks from rotation about the cam lock pins.

* * * * *